United States Patent [19]

Myreen

[11] 4,153,420

[45] May 8, 1979

[54] PROCESS FOR WET CARBONIZING OF PEAT

[75] Inventor: Bertel Myreen, Abo, Finland

[73] Assignee: Ra Shipping Ltd. Oy, Pargas, Finland

[21] Appl. No.: 890,702

[22] Filed: Mar. 27, 1978

[30] Foreign Application Priority Data

Apr. 19, 1977 [FI] Finland ..... 771235

[51] Int. Cl.[2] ..... C10F 5/00; C10F 7/00; C10B 57/12

[52] U.S. Cl. ..... 44/33; 44/27; 201/25; 201/38

[58] Field of Search ..... 44/27, 33; 201/25, 38

[56] References Cited

U.S. PATENT DOCUMENTS

| | | | |
|---|---|---|---|
| 865,537 | 9/1907 | Smith | 44/33 |
| 1,074,400 | 9/1913 | Wolters | 44/33 |
| 1,347,940 | 7/1920 | Edgeworth | 44/33 |
| 3,436,314 | 4/1969 | Leonor | 201/25 |

FOREIGN PATENT DOCUMENTS

| | | | |
|---|---|---|---|
| 231592 | 4/1925 | United Kingdom | 44/33 |

*Primary Examiner*—Carl Dees

*Attorney, Agent, or Firm*—Browdy and Neimark

[57] ABSTRACT

A process for the wet carbonizing of peat, wherein the peat is diluted and screened to become a raw peat suspension in a suspension preparing apparatus, the peat suspension thus obtained is preheated in series-connected heat exchangers and in a preheating tower, the preheated suspension is wet carbonized in a reactor into which steam is introduced from a steam boiler, the wet carbonized peat suspension is cooled in the preheating tower, mechanically dewatered in a dewatering apparatus and dried in a drying apparatus with the aid of hot drying gas, the exhaust gases from the boiler being employed as drying gas in the drying apparatus and the dust and water vapor containing exhaust gas emerging from the drying apparatus being purified and cooled in a wet separator, wherein part of the water vapor in the exhaust gas condenses and wherein there is used as washing water, polluted water coming from the dewatering apparatus and being cooled by heat exchange with the raw peat suspension in the heat exchanger, and the dust-laden and heated drain water from the wet separator being used as dilution water in the suspension preparing apparatus.

7 Claims, 1 Drawing Figure

PROCESS FOR WET CARBONIZING OF PEAT

BACKGROUND OF THE INVENTION

1. Field of the Invention

The present invention relates to a process for wet carbonizing of peat.

2. Description of the Prior Art

Wet carbonizing of peat implies chemical decomposition of raw peat, which takes place in liquid phase at temperature about 200° C. under pressure, and during which reaction carbon dioxide, water and certain organic impurities are split off from the peat dry substance. Hereby the carbon content of the dry substance increases, and it loses its gel-resembling structure, whereby it becomes possible to remove water mechanically by filtering and pressing from the wet-carbonized peat suspension to such degree that the press cake will have a dry matter content up to 50%. After thus the major part of the water has been mechanically removed from the wet-carbonized peat suspension, an essential part of the residual water content may be removed by thermal drying.

The product thus prepared, that is dry wet-carbonized peat, is mainly used as fuel in energy producing or as raw material for further conversion in to products—such as peat cokes for instance—in which also the energy content plays a remarkable role. Decisive significance with regard to the economy of a wet carbonizing plant attaches to an exhaustive heat recovery in the process, since optimum energy economy also gives an optimum energy yield.

At the same time, naturally, the losses of dry substance from the process to the environment should be minimized.

In proposals for wet carbonizing plants existing in prior art, the heat recovery has been partly taken into account. For instance, the company Ab Svensk Tor vforadling shows in a stencilled report of the year 1960 how it is possible with the hot peat suspension flowing from the wet carbonizing reactor to preheat the raw peat suspension flowing to the reactor, and also how the hot filtrate obtained from the filter presses can be utilized towards preheating the raw peat suspension. However, in this plant description one has failed to connect a steam boiler required in the plant, on the flue gas side, with a thermal drying means for the drying of the wet carbonized peat, nor has any other such heat recovery from the exhaust gases of the steam boiler or of the separate drying means been planned which would have any influence on the heat economy of the wet carbonizing plant itself.

SUMMARY OF THE INVENTION

The present invention provides a process of the character once descriped, which comprises a process for wet carbonizing of peat, which comprises diluting and screening raw peat in a suspension preparing apparatus to prepare a pumpable aqueous raw peat suspension, preheating said suspension in series-connected heat exchangers and in a preheating tower, feeding the preheated suspension into a reactor to be wet carbonized therein, introducing steam from a steam boiler into said reactor for the wet carbonizing of the peat suspension, cooling the wet carbonized peat suspension by heat exchange in the preheating tower, dewatering mechanically the cooled peat suspension in a dewatering apparatus, drying the dewatered peat suspension in a drying apparatus, hot exhaust gases from the boiler being introduced as drying gas into the drying apparatus, purifying and cooling in a wet separator exhaust gas emerging from the drying apparatus and containing dust and water vapour, part of said water vapour being condensed in said wet separator, polluted water coming from the dewatering apparatus being cooled by heat exchange with the raw peat suspension in the heat exchanger and, thereupon, being introducted as washing water into said wet separator, and returning dustladen and heated drain water from the wet separator to the suspension preparing apparatus to be used as dilution water therein.

An object of the present invention is to provide a procedure for operating a plant serving the wet carbonizing of peat in such manner that efficient exhaust gas purification relating to several pieces of equipment comprised in the plant is combined with a product and heat recovery in the plant.

It is a characterizing feature of the present invention that exhaust gases from the steam boiler are employed as drying gas in the drying apparatus, that polluted water from the dewatering apparatus is used, after cooling by heat exchange with the raw peat suspension, as washing water in the wet separator, and, finally, that dust-laden warm drain water coming from the wet separator is used as dilution water in the suspension preparing apparatus.

DESCRIPTION OF THE PREFERRED EMBODIMENT

Figure 1:
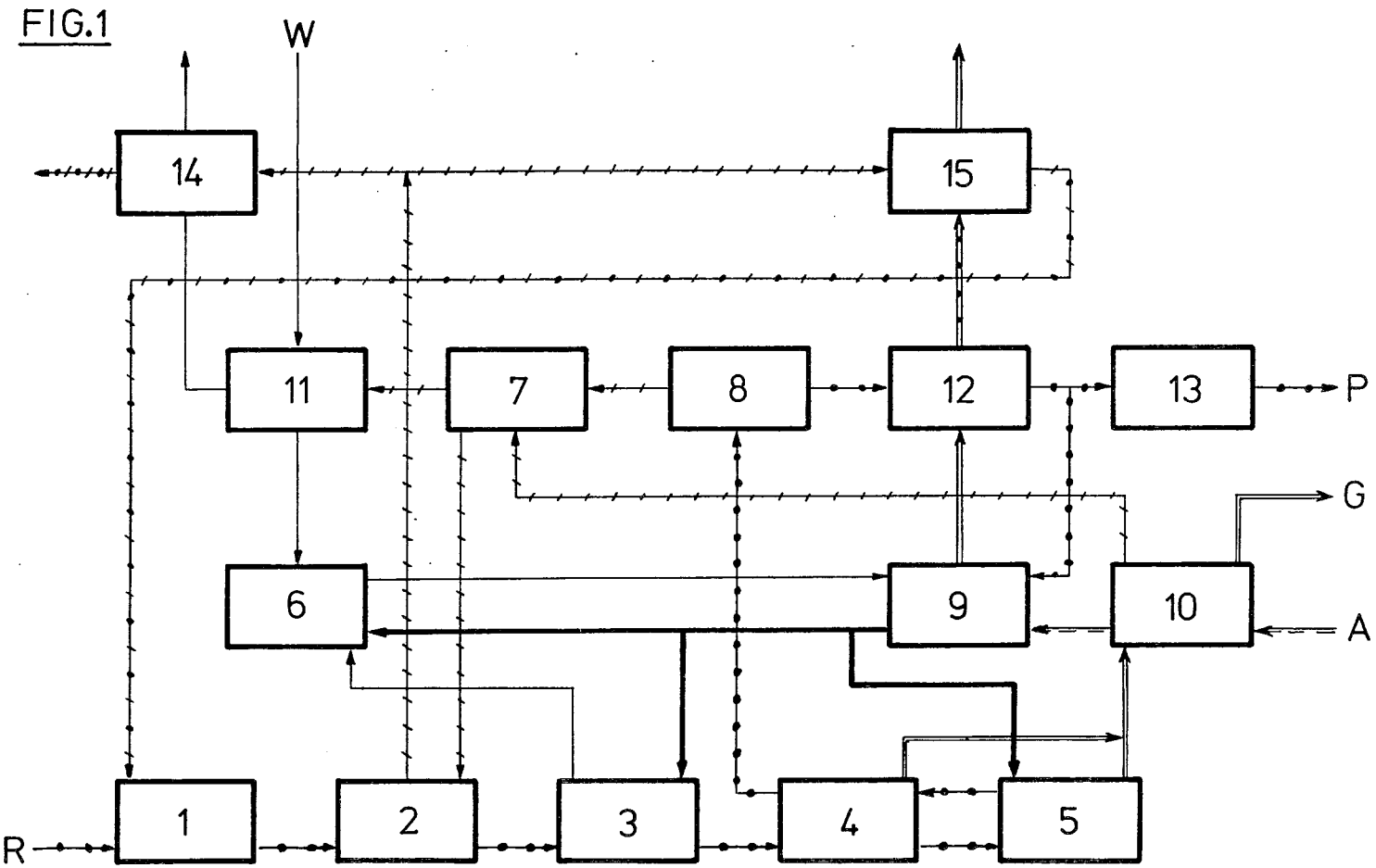

The enclosed drawing shows in the form of a schematic block diagram a plant for carrying out the process according to the present invention.

Raw peat R is introduced from the outside into the suspension preparing apparatus 1, where preparation of the suspension is in progress by the addition of warm water. This warm water is obtained from a wet separator 15, which is a piece of apparatus essential for the new circuit. The peat suspension is transported through a heat exchanger 2, where it is heated by means of warm water which is taken from a warm water container 7, and further through a heat exchanger 3, where it is heated with steam obtained from a steam boiler 9. From the heat exchanger 3, the raw peat suspension is pumped through a preheating tower 4, where it is additionally heated, now by expansion steam from hot wet carbonized peat suspension, as will be described farther below. From the preheating tower 4, the raw peat suspension is pumped to a reactor 5, where additional steam is introduced from the boiler 9 and where the wet carbonizing reaction takes place. The wet carbonized peat suspension flowing out from the reactor is conducted back to the preheating tower 4, where it is induced, under stepwise diminution of pressure, to release expansion steam with simultaneous cooling down to a temperature lower than 100° C. From the preheating tower 4, the wet carbonized suspension is conducted to a separator 8, where mechanical separation of liquid from the suspension takes place. From here the dry substance is conducted to a thermal drying apparatus 12, while the liquid is conducted to the warm water container 7.

The steam required in the heat exchanger 3 and in the reactor 5 is generated in the boiler 9, the exhaust gases from this boiler being used as drying gases in the drying apparatus 12, which is preferably a suspension dryer. Of the dry wet carbonized peat emerging from the drying apparatus 12, a fraction is used for fuel in the boiler 9, while the major part is compacted in an apparatus 13 to become the finished product P. Fuels other than wet carbonized peat may also be used in the boiler. The combustion air A consumed in the firebox of the boiler is preheated in air preheater 10 by degassing vapour from the preheater tower 4 and from the reactor 5. The condensate of the degassing vapour is conducted to the warm water container 7, while uncondensable gases G, mainly consisting of carbon dioxide, are released into the atmosphere.

In order to make up for the pure condensate losses in the plant, pure water W is drawn into the plant. This water is preheated in a heat exchanger 11 by warm water and it is conducted to a feed water container 6, whence it is pumped to the boiler 9 together with condensate from the heat exchanger 3. The warm water required for preheating the pure water in the heat exchanger 11 is taken from the warm water container 7 and further conducted to an apparatus 14 serving for the purification of the drain water. The polluted water emerging from the heat exchanger 2 is conducted, in part, to the drain water purifying apparatus 14 and—as an important feature of the invention—to the wet separator 15. This wet separator serves a twofold purpose. Partly, it purifies the exhaust gases from the boiler 9 as well as from the drying apparatus 12, removing the solid particles present in the washing water emerging from the wet separator 15. In addition, the exhaust gases are efficiently cooled in the wet separator and water vapour present in the exhaust gas condenses, to a substantial fraction, in the wet separator, whereby heating of the washing water flowing through the wet separator is effected. In order to achieve a suitable liquid/gas proportion in the wet separator 15, part of the emerging washing water may be circulated in the apparatus. This recirculation has not been indicated in FIG. 1, however. The dust-laden and heated washing water emerging from the wet separator is used as make-up water in the suspension preparing apparatus 1.

The part of the plant circuit not known in prior art consists of the way in which the boiler 9, the thermal drying apparatus 12 and the wet separator 15 have been interconnected and connected to the warm water container 7, the heat exchanger 2 and the suspension preparing apparatus 1. Furthermore, the use of the degassing vapour from the preheating tower 4 and from the reactor 5 as heating fluid in the air preheater 10 is not known in prior art.

The boiler 9 can be a tube boiler with a radiation firebox provided with combustion means for stoking with wet carbonized peat. Alternatively, it can comprise a fluidized bed roaster, wherein the heat transfer surfaces are at least partially disposed in the fluidized bed and wherein the fuel is introduced in such manner that the combustion takes place mainly in the fluidized layer. Furthermore, the drying apparatus 12 may comprise mainly a dryer tube, into which the material to be dried is introduced in finely divided form and through which the material flows concurrently and in direct contact with the drying gas, being separated at the tube outlet from the drying gas by means of a dust separating apparatus operating without liquid supply.

Finally, the wet separator 15 comprise a Venturi scrubber or, alternatively, a douche tower, wherein a partial flow of emerging washing water is returned to the water input so that a suitable gas/liquid proportion is obtained, the residual washing water flow being conducted to the suspension preparing apparatus. The exhaust gas and the washing water are conducted in concurrent mode in a Venturi scrubber, whereas in countercurrent mode in a douche tower.

The apparatus circuitry described here presents great advantages over apparatus circuits known at present. By connecting together the boiler and the drying apparatus in the manner now described, the after-heating surfaces of the boiler (its water preheating and air preheating economizers) may be omitted. Likewise, no separate dust separator is required for the boiler. Since the hot exhaust gases from the boiler are used as drying gas in the drying plant, this plant requires no separate drying gas generator. The cyclone separators belonging to a dryer operating with hot gas cannot completely separate the dry matter from the drying gas. In conventional drying plants a secondary gas purification must take place with, for instance, bag filters so that no product losses along with the exhaust gas might be incurred. In the procedure of the invention concerning the way of operating the plant, the secondary gas purification may be carried out with a considerably less expensive wet separator, without incurring any product losses to the environment, since the drain water from the wet separator is returned as dilution water to the main product flow. It is also an essential advantage that the drain water cooled in the heat exchanger 2 is again reheated in the wet separator and therefore returns a remarkable quantity of energy from the exhaust gas to the raw peat suspension, whereby the heat economy of the plant is improved.

For the event that a fuel is burned in the boiler which requires preheated combustion air or which enables preheated combustion air to be used, this preheating may take place by means of the degassing vapour from the preheating tower and from the reactor. The energy of the degassing vapour is in this manner returned to the process, and good enough degassing may take place in the said pieces of equipment without detriment to the heat economy of the plant, while at the same time preheated combustion air is obtained, although the boiler has no air preheater in the flue gas path.

What is claimed is:

1. A process for wet carbonizing of peat, which comprises preparing a pumpable aqueous suspension of raw peat, preheating said suspension in series-connected heat exchangers and in a preheating tower, feeding the preheated suspension into a reactor to be wet carbonized therein, introducing steam from a steam boiler into said reactor for the wet carbonizing of the peat suspension at a temperature of about 200° C., cooling the wet carbonized peat suspension by heat exchange in the preheating tower, dewatering mechanically the cooled peat suspension in a dewatering apparatus, drying the dewatered peat suspension in a drying apparatus, hot exhaust gases from the boiler being introduced as drying gas into the drying apparatus, purifying and cooling in a wet separator exhaust gas emerging from the drying apparatus and containing dust and water vapour, part of said water vapour being condensed in said wet separator, polluted water coming from the dewatering apparatus being cooled by heat exchange with the raw peat suspension in the heat exchanger and, thereupon, being introduced as washing water into said wet separator, and returning dust-laden and heated drain water from the wet separator to the suspension preparing apparatus to be used as dilution water therein.

2. Process according to claim 1, wherein there is used a boiler having no air preheating economizer in the flue gas path, the combustion gas for the boiler being preheated in a separate heat exchanger with the help of condensing exhaust gas vapours from the preheating tower and the reactor.

3. Process according to claim 1, wherein the boiler is a water tube boiler with a radiation firebox having combustion means for stoking with wet carbonized peat.

4. Process according to claim 1, wherein the boiler consists of a fluidized bed roaster with heat transfer surfaces at least partially disposed in the fluidized layer, which is fluidized with the combustion air and into which the fuel is introduced in such manner that the combustion mainly takes place in the fluidized layer.

5. Process according to the claim 1, wherein the drying apparatus is a suspension dryer, consisting mainly of a dryer tube into which the material to be dried coming from the dewatering apparatus is introduced in finely divided form and through which the material flows in concurrent mode and in direct contact with the drying gas from the boiler, in order to be separated at the output end of the drying tube from the drying gas by means of a dust separating apparatus operating without any addition of liquid.

6. Process according to claim 1, wherein the wet separator is a Venturi scrubber, through which the exhaust gas and washing water are conducted in concurrent mode and wherein a partial flow of emerging washing water is returned to the washing water input so that a suitable gas/liquid proportion might be obtained in the scrubber, the residual washing water flow being conducted to the suspension preparing apparatus.

7. Process according to claim 1, wherein the wet separator is a douche tower wherein the exhaust gas and washing water substantially flow in countercurrent mode, and wherein a partial flow of emerging washing water is returned to the washing water input in order that a suitable gas/liquid proportion might be obtained in the douche tower, the residual washing water flow being conducted to the suspension preparing apparatus.

* * * * *